United States Patent [19]

Bulso, Jr. et al.

[11] Patent Number: 4,923,139

[45] Date of Patent: May 8, 1990

[54] COIL FEEDING SYSTEM, MEHOD AND APPARATUS

[75] Inventors: Joseph D. Bulso, Jr., Canton; William R. Lewers, North Canton, both of Ohio

[73] Assignee: Redicon Corporation, Canton, Ohio

[21] Appl. No.: 248,594

[22] Filed: Sep. 26, 1988

[51] Int. Cl.[5] ..... B21C 47/16; B65H 23/02

[52] U.S. Cl. ..... 242/78.6; 83/418; 226/3; 226/19

[58] Field of Search ..... 226/3, 15, 16, 17, 18, 226/19, 20, 21, 22, 117; 242/78.6; 83/412, 418, 420, 421

[56] References Cited

U.S. PATENT DOCUMENTS

| | | | |
|---|---|---|---|
| 2,646,278 | 7/1953 | Partridge | 83/420 X |
| 3,848,788 | 11/1974 | Buta | 226/19 |
| 3,974,949 | 8/1974 | Petersen | 226/117 X |
| 4,054,251 | 10/1977 | Henderson et al. | 226/15 X |
| 4,073,448 | 2/1978 | Kolosov | 226/22 X |
| 4,144,782 | 3/1979 | Lindstrom | 83/420 X |
| 4,255,999 | 3/1981 | Davis | 83/420 X |
| 4,685,664 | 8/1987 | Petersdorf | 226/20 X |

*Primary Examiner*—Daniel P. Stodola

*Attorney, Agent, or Firm*—Reese Taylor

[57] ABSTRACT

A multi-directional system, method and apparatus for feeding stock from a coil into a press in a principal feed direction and selectively in a direction normal to the principal feed direction includes an uncoiler, a compensator, a feeder and a press arranged in series with the feeder and the compensator being engagable with the stock to feed it in the principal feed direction into the press and being shiftable transversely of the principal feed direction to shift the stock in that direction while the leading end of the stock is received within the press.

14 Claims, 5 Drawing Sheets

COIL FEEDING SYSTEM, MEHOD AND APPARATUS

BACKGROUND OF THE INVENTION

This invention relates in general to feeding coil stock from a supply source into a press for the performance of various forming operations. The invention relates in particular to a system, method and apparatus for feeding coil stock into a press along a principal direction of feed and also shifting the stock in a direction normal to the principal direction of feed during the time the stock is within the press.

DESCRIPTION OF THE PRIOR ART

It is well-known in the prior art to take coiled stock of various materials from a source of supply which is normally, of course, a coil and feed it into a press whereupon the press will perform certain forming functions on the material. By utilization of a source of supply constituting a coil the operation of the press becomes essentially continuous as the essentially endless coil continues to feed into the press and supply new material for repetitive press operations.

Systems of this general type are common in many fields, but this particular application will be illustrated and described in connection with the feeding of stock of this nature into a reciprocating press wherein blanking, drawing and redrawing operations are performed on the material by the tooling carried by the press.

Generally, the stock, such as, for example, steel or aluminum, is produced by the mills in standard widths such as, for example, 40 inches. This stock is then fed into the basically standard width press in a principal direction of feed. In a high volume or high production situation, the press normally carries multiple sets of tooling so that, as the material is indexed into the press along the principal direction of feed, all or substantially all of the width of the stock will be utilized by the tooling with a minimum of scrap or waste.

Difficulties, however, can arise from a practical standpoint where a low volume system is desired and wherein the stock material is still desired to be supplied from a mill width coil. The difficulty is that the stock will still be provided by the mill in a predetermined width, such as, for example, 40 inches, as noted. The press will also still normally be of a predetermined width. As noted, in the instance where multiple sets of tooling are provided, it is possible to provide suitable sets of tooling so that the parts being stamped out will be stamped out in a pattern which more or less fully utilizes the width of the stock.

However, in the low volume operations where, for example, only two sets of tooling are employed, it is obvious that the stock material on each indexing into the press will present only a small percentage of its total width to the tooling. This results in either scrapping the rest or running the material through the press again, neither of which are feasible from a practical standpoint. One solution is to utilize narrower widths of material and it is possible, of course, to have the widths specially milled, but here again the cost is prohibitive.

Therefore, it is desirable to provide a system, method and apparatus for retaining the advantages a coil feed provides while making it possible to fully and efficiently utilize mill width stock in a standard press on a low volume basis.

SUMMARY OF THE INVENTION

It is, accordingly, a principal object of this invention to provide a system, method and apparatus wherein stock can be paid off of a coil, fed into a press for forming operations in a principal path of movement and also shifted laterally while still in the press so as to fully utilize the width of the material with a minimal number of sets of tooling.

In accomplishing this object, it is has been found that such a system, method and apparatus can be produced by providing a feeder apparatus disposed adjacent the press and capable of indexing the stock in a principal feed direction and shifting it in a direction normal to that feed direction. Since coil stock is involved and is essentially endless for practical purposes, such shifting alone would present serious difficulties because the sheet of material would have a tendency to twist between the feeder and the nonshifting coil.

Accordingly, it has been found that provision of a compensator apparatus, which itself is shiftable in a direction normal to the principal feed path, will compensate for the twisting tendency of the material and will make it possible, when the compensator moves laterally in synchronized relationship with the feeder apparatus, to shift the stock in a direction normal to the principal path of feed to again thereby fully utilize the width of the stock.

It has been found that if this compensator apparatus is disposed between the coil and the feeder apparatus and spaced a suitable distance from each, the material will be maintained in proper position with any twisting tendency thereof being confined to the area between the compensator apparatus and the coil where it presents no serious problems.

Accordingly, production of an improved system, method and apparatus for feeding coil stock into a press in two directions becomes the principal object of this invention with other objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Figure 2:
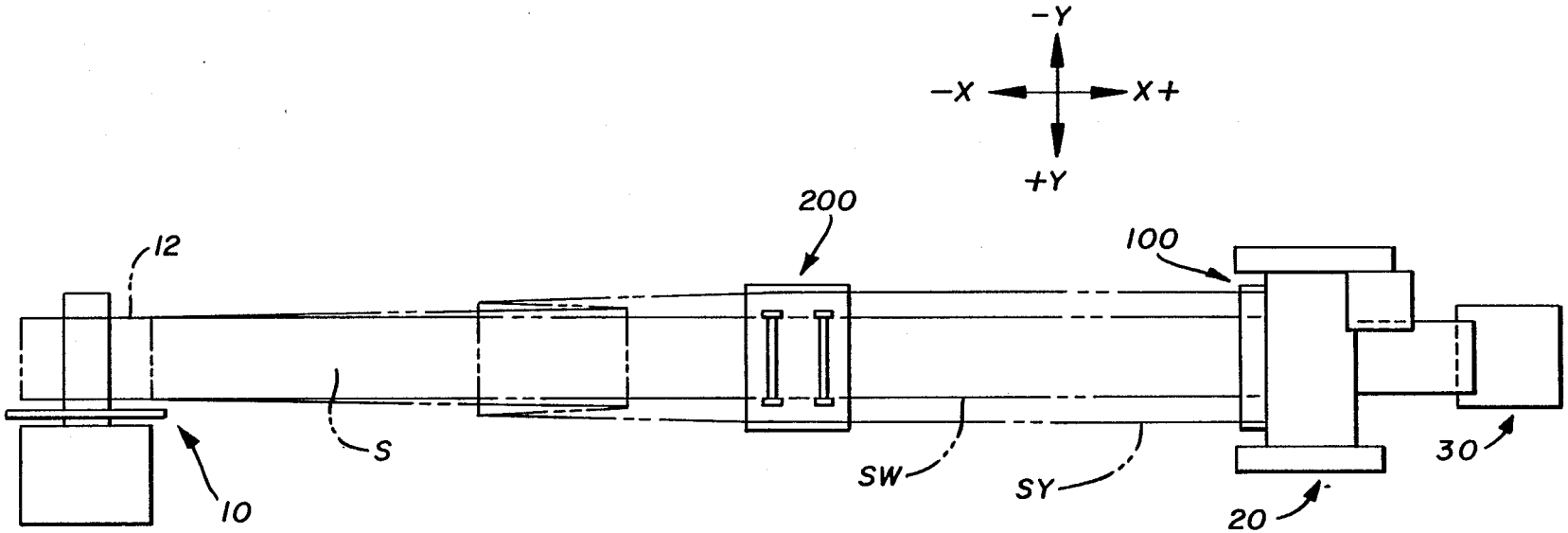
FIG. 2 is a schematic top plan view thereof.
Figure 1:
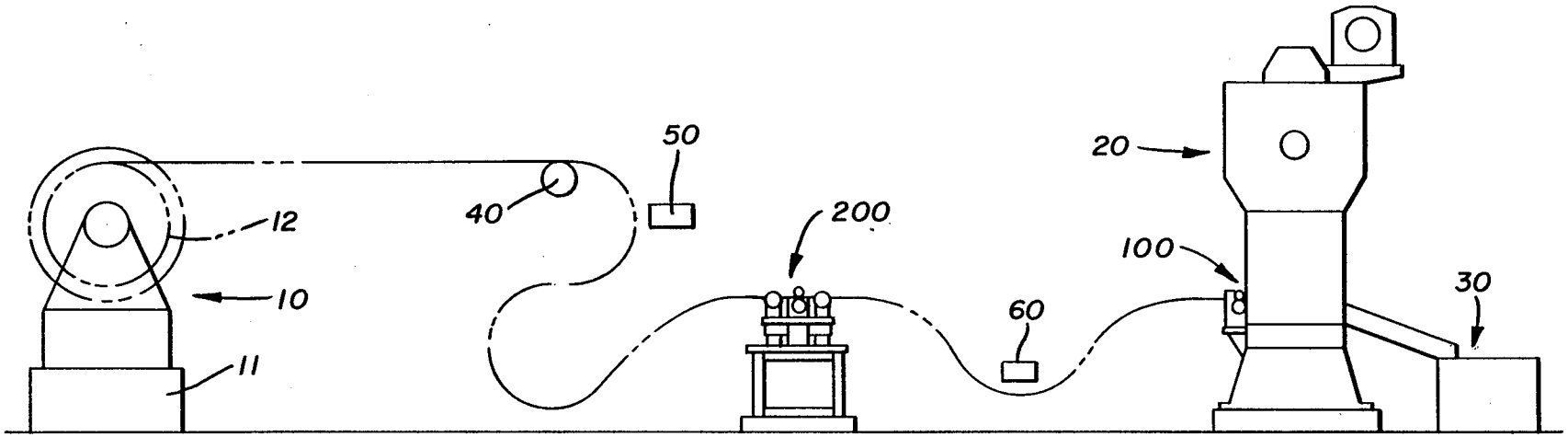
FIG. 1 is an elevational, schematic line layout view of the improved system.
Figure 4:
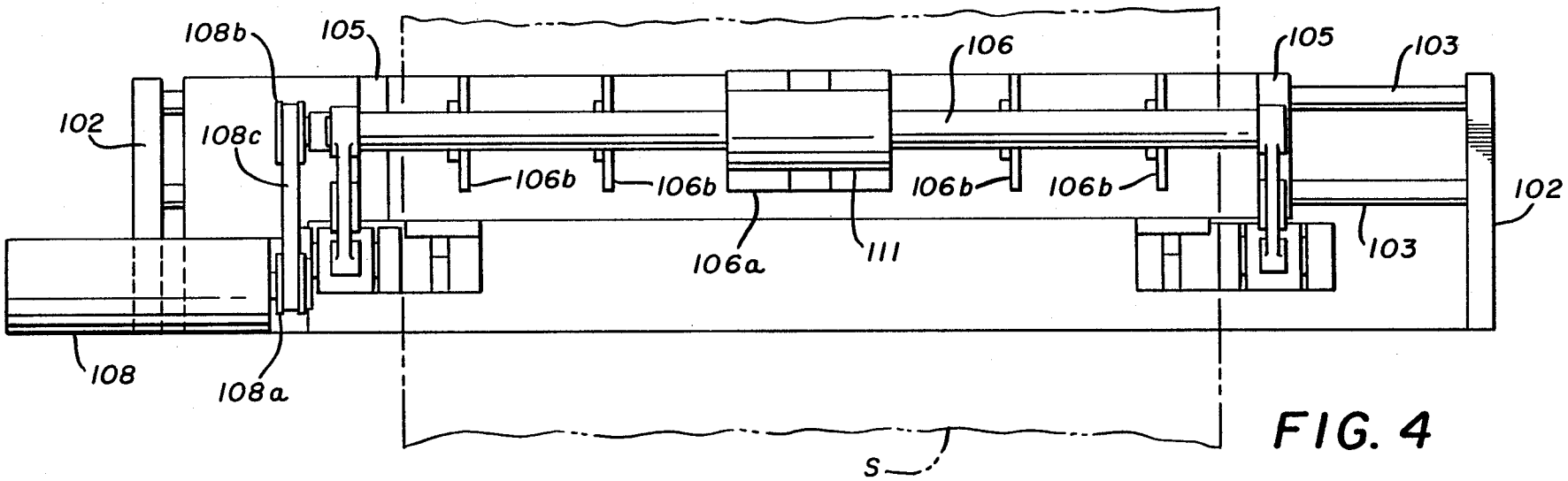
FIG. 4 is a top plan view, partially in section, of the feeder apparatus.
Figure 3:
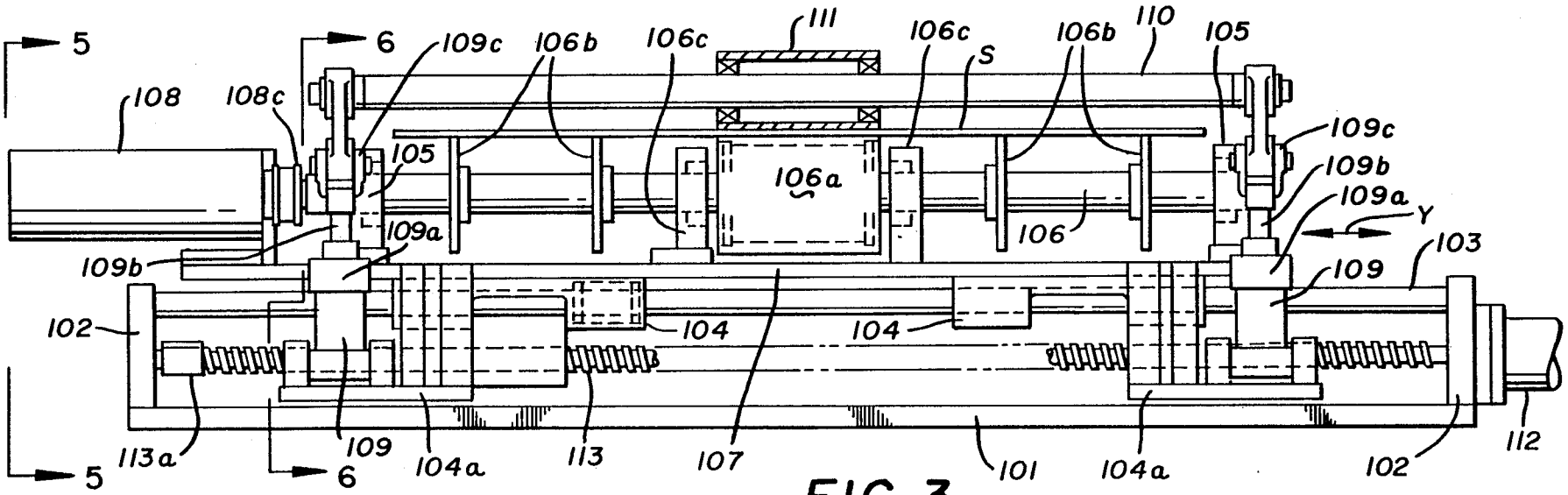
FIG. 3 is an elevational view, partially in section, of the feeder apparatus.
Figure 6:
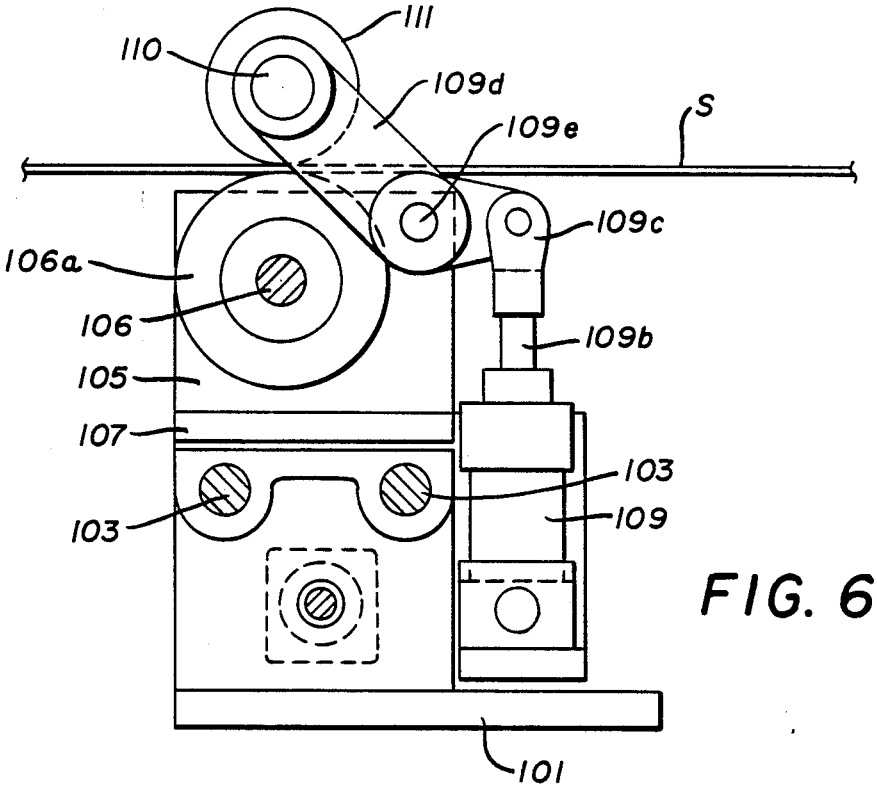
FIG. 6 is a sectional view taken along the line 6—6 of FIG. 3.
Figure 5:
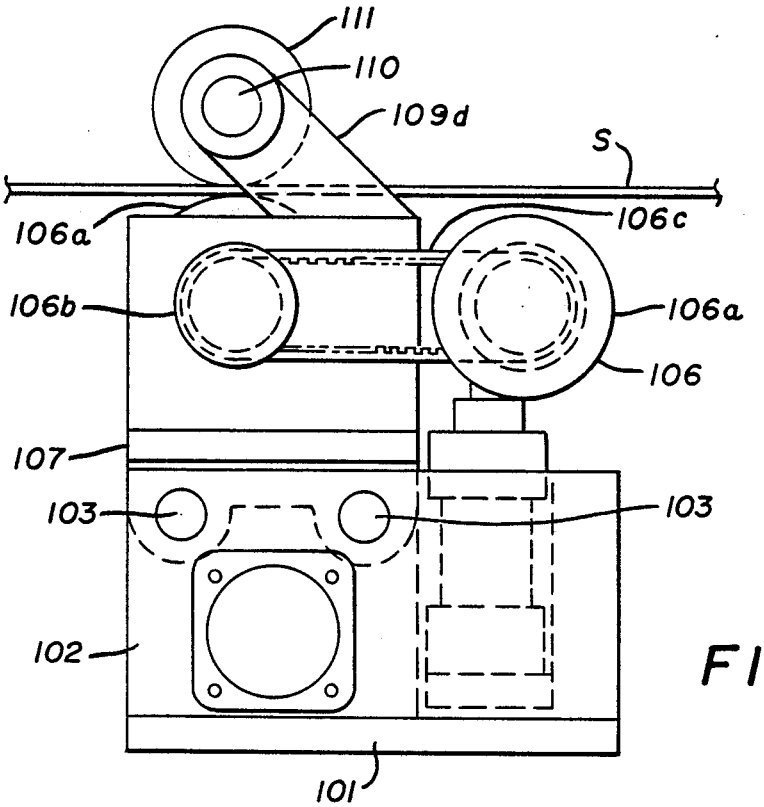
FIG. 5 is an end elevational view taken along the line 5—5 of FIG. 3.

Referring first to FIGS. 1 and 2, it will be noted that these are line layout views which are essentially schematic in nature. With that in mind and again referring to FIGS. 1 and 2, it will be noted that the system essentially consists of an uncoiler 10, a compensator apparatus 200, a feeder apparatus 100, a press 20 and a scrap receptacle 30.

The uncoiler 10 has a floor mounted base 11 and carries on it a coil 12 of stock S. No detailed description of the uncoiler 10 is provided here, since such structure is well-known in the art. It also ought to be noted that, depending upon the end use to which the stock material S is to be put, such as in a can making operation, it might be possible to interpose a lubricator to the right of the uncoiler 10, as viewed in FIGS. 1 and 2. This is an optional installation, again depending upon the end use of the material and not affecting the multi-directional nature of the present invention.

Still referring to FIGS. 1 and 2 of the drawings and briefly referring in general terms to the operation, it will be seen that the stock S is paid off the uncoiler 10 over a support roll 40 past a sensor 50 and through the compensator 200. The sensor 50 will sense the loop formed in the stock, which is clearly illustrated in FIG. 1 of the drawings, and send a signal to the uncoiler 10 to release more stock. No detail will be described herein with regard to this sensing operation, since it is conventional, although its relationship to the overall operation of the system will be described in greater detail below.

Still referring to FIGS. 1 and 2 and still briefly describing the operation of the system, it will be noted that the stock S, after passing the sensor 50, is fed through the compensator 200, and after passing a second sensor 60, passes on to the feeder 100 which is mounted on or closely adjacent to the press, and into the press 20 where the tooling in the press will perform its usual operations. The sensor 60 serves to sense the loop with which it is associated to activate the compensator 200 when required, as will be described.

As can be seen in FIGS. 1 and 2, the principal direction of feed is in the positive X direction from the uncoiler 10 to the press 20. Theoretically, the stock could also be moved in a negative X direction, but the usual feed is in the positive X direction or from left to right of FIGS. 1 and 2. FIGS. 2 also schematically shows the normal stock width indicated by the letters SW and the maximum Y axis movement indicated by the letters SY. Details of the operation of the system will be provided following a detailed description of the apparatus.

Referring next then to FIGS. 3 through 6 of the drawings for a detailed description of the feeder apparatus, it will be noted that the feeder apparatus, generally indicated by the numeral 100, includes a base 101 and opposed guide rod holders 102,102 projecting upwardly from the base. These guide rod holders 102,102 receive the opposed ends of parallel guide rods 103,103. Guide rod blocks 104,104 are slidably received on the rods 103,103 and are secured to and support a roll mounting plate 105. The guide rod blocks 104,104 also are attached to and support, in depending relationship, brackets **104*a*,104*a***.

Projecting upwardly from the roll mounting plate 107 are opposed bearing mounting blocks 105,105. The bearing mounting blocks 105,105 also receive opposed ends of a power roll shaft 106 which carries with it a power roll **106*a* and stock supports 106*b*,106*b* which support stock S as it passes through the feeder 100. Power roll shaft 106 is also supported adjacent its axial midpoint by supports 106*c*,106*c* which are secured to and project upwardly from roll mounting plate 107**.

It will be noted that the power roll shaft 106 is driven by a servo mechanism 108 which is also mounted on plate 107. Servo 108 is connected to power roll shaft 106 through pulleys **108*a* and 108*b* and timing belt 108*c* whereby the power roll 106 may be driven by the servo 108** to advance the stock into the press along the X axis.

Also carried on the plate 107 are opposed cylinder brackets 109,109 and these cylinder brackets 109,109 support air cylinders **109*a*,109*a*. The air cylinders 109*a*,109*a* each have a projecting air cyliner rod 109*b* with a clevis 109*c* on its projecting end. A pressure arm 109*d* is secured to each clevis and is pivotally mounted as at 109*e*. The projecting end of each of the pressure arms 109*d*,109*d* engages and supports the opposed ends of the idler roll shaft 110 which, in turn, supports idler roll 111, making it possible, when desired, to actuate the air clyinders 109*a*,109*a* and lift the pressure roll 111** off the stock S.

It will be noted from the drawings that the direction of rotation of the power roll shaft 106 and power roll **106*a* will be in the principal direction of feed or in the positive X direction or, in other words, toward the press 20. It will also be noted, however, that the entire apparatus carried by plate 107** is shiftable in the Y direction or a direction normal to the principal path of feed of the material into the press. In this way, as will be seen, the material can be shifted after being inserted into the press so that full utilization of the width of the stock can be achieved.

In that regard, it will be noted that the guide rod holders 102,102 also support servo 112 which drives ball screw 113 through ball screw coupling **113*a*. Since screw 113 is in operative engagement with brackets 104*a*,104*a*, which are fixed to roll mounting plate 107, the entire feeder apparatus, except for the servo 112, screw 113, base 101, rod holders 102,102 and rods 103,103**, moves in the Y axis direction. This is the direction normal to feed direction X and makes it possible to shift the material which extends from the feeder into the press in that direction.

As pointed out above, however, since the stock is coming off the uncoiler 10, which does not shift in the Y direction, and since the stock is an essentialy endless piece of material, if only the feeder 100 were employed, the stock would tend to twist and bend somewhere between the uncoiler 10 and the feeder 100 when the feeder is shifted. For that reason, the compensator apparatus 200, which will now be described, is employed.

Figure 7:
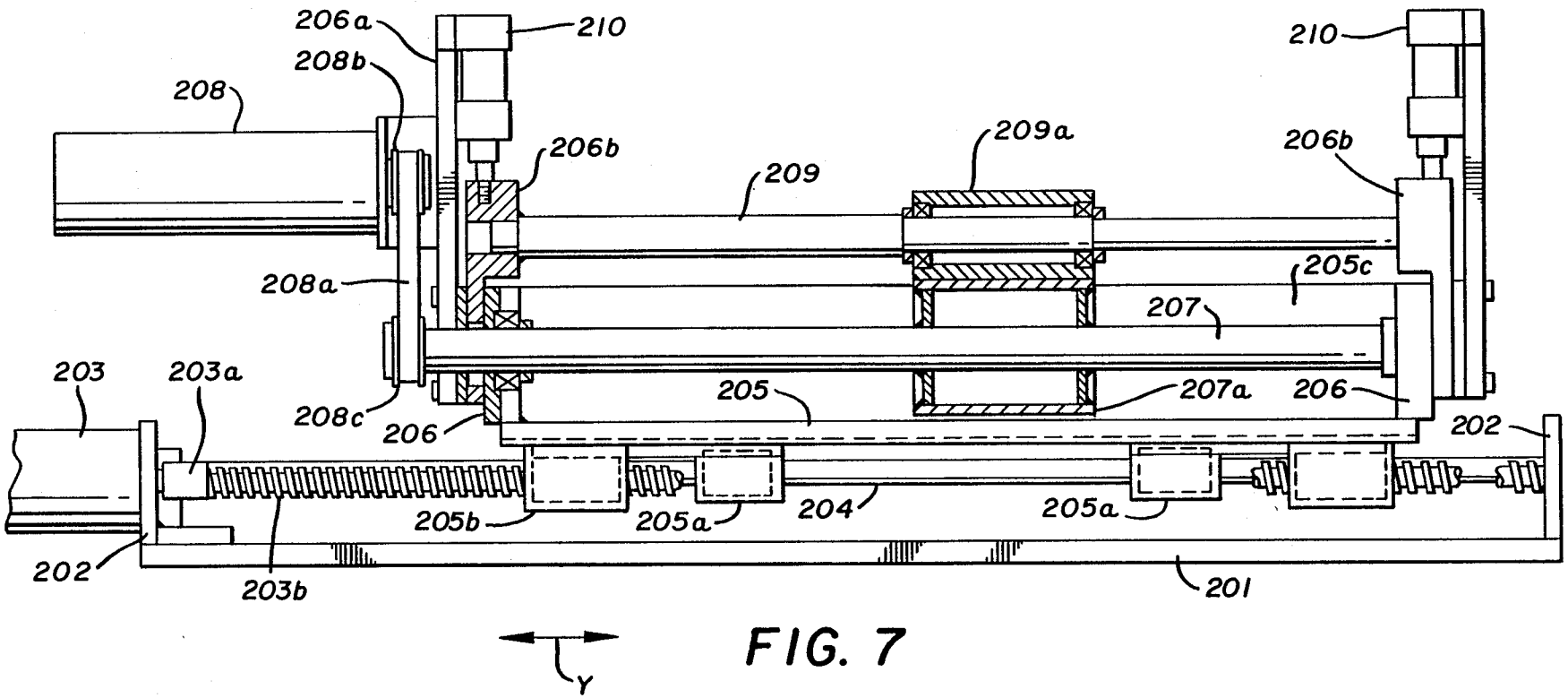
FIG. 7 is an elevational view of the compensator apparatus, partially in section.
Figure 9:
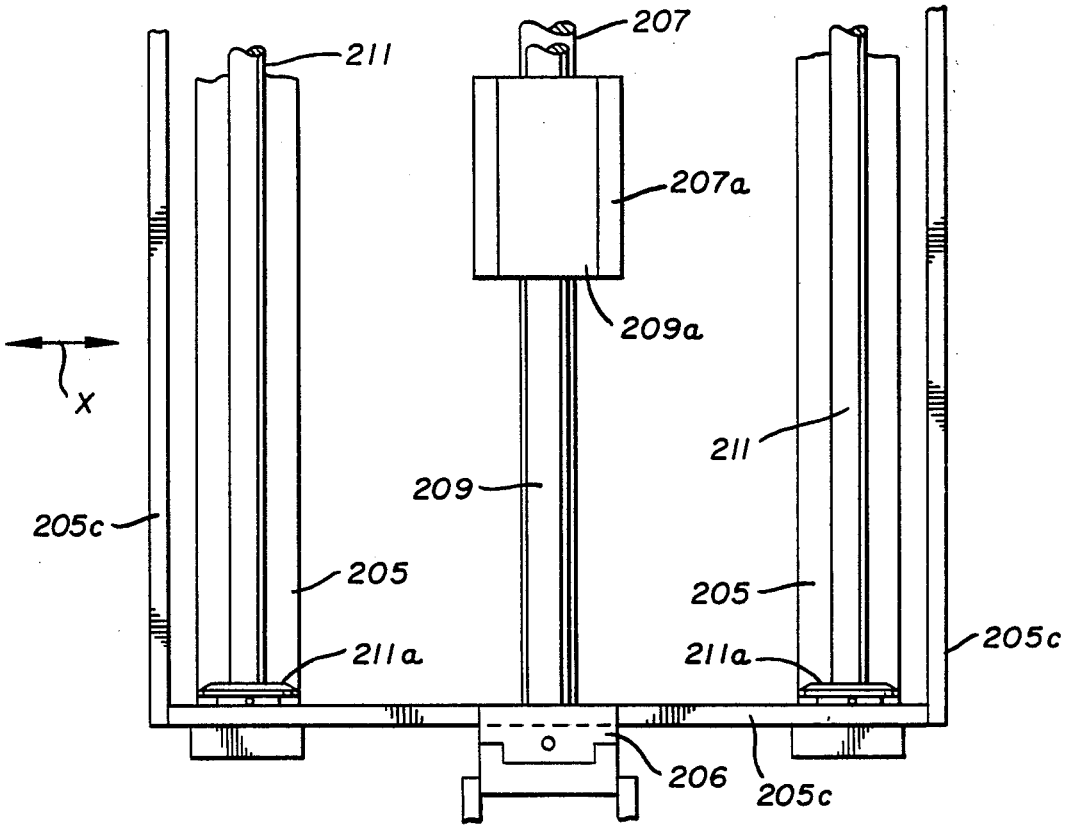
FIG. 9 is a top plan view, partially broken away, of the compensator apparatus.
Figure 8:
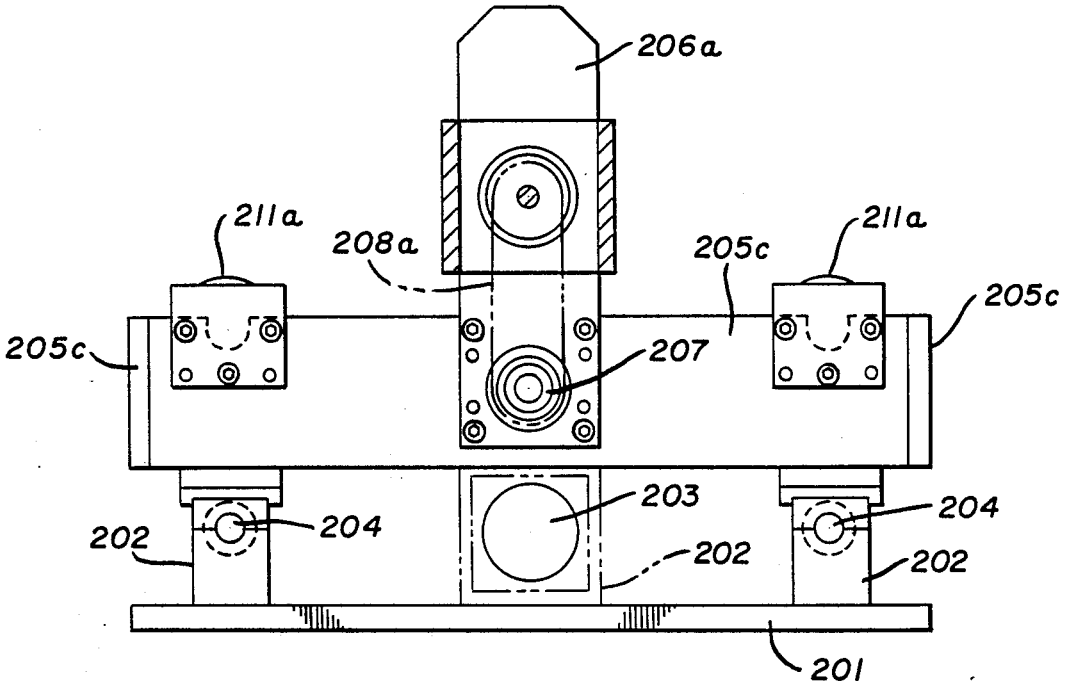
FIG. 8 is a view of the compensator apparatus taken along the line 8—8 of FIG. 7.

Turning next then to FIGS. 7, 8 and 9 of the drawings for a detailed description of the compensator apparatus 200, it will be noted that the compensator essentially includes a base plate 201 and three sets of opposed end plates 202 projecting upwardly therefrom. The servo 203 is mounted on one of the middle end plates 202 and is connected to a ball screw coupling **203*a* and a ball screw 203*b* which has its opposed end supported by the opposed middle end plate 202. The outboard end plates 202 support opposed ends of parallel guide rods 204,204**.

A pair of support plates 205,205 are provided and these support plates are secured to depending slide rod brackets **205*a*,205*a* which slide along guide rods 204,204. The plates 205 are also connected to the ball screw 203*b* by a ball nut 205 so that rotation of the ball screw 203*b* will drive the plate 205 and its associated mechanism either to the left or to the right of FIG. 7** of the drawings, as will be described.

Projecting upwardly from each plate 205 are wall members **205*c* which form a box-like structure and opposed roll support frames 206,206**. These support frames carry several additional components.

Specifically, the frames 206,206 carry a power roll shaft 207 to which is affixed a power roll 207*a*. One of the frames 206 also carries a mounting plate 206*a* to which is secured a servo 208 which drives the timing belt 208*a* through pulleys 208*b* and 208*c*. Pulley 208*c* is connected to the end of power roll shaft 207 so that the servo may rotate the power roll 207*a* through timing belt 208*a*. In this fashion, it is possible to rotate the power roll 207*a* and the normal direction of rotation is again in the same direction as the principal feed path of the stock.

Also carried on extensions 206*b*,206*b* of the frames 206,206 is a pressure roll shaft 209 which carries a pressure roll 209*a* so that the roll 209*a* can cooperate with the roll 207*a* and, in this fashion, the stock will be fed toward the press when desired.

Also mounted on the frame extensions 206*a*,206*a* are air cylinders 210,210 which are extendable and retractable so as to lift the pressure roll 209*a* up off the stock when desired or required.

As previously noted, the support plates 205,205, together with wall members 205*c*, form a box-like structure. Referring to FIG. 9, opposed end walls 205*c*,205*c* support stock support shafts 211 which carry guides 211*a*,211*a* at their opposed ends. In this fashion, the stock may be aligned laterally with respect to the X direction by the guides 211*a*,211*a*.

It will be apparent from the drawings that rotation of the power roll 207*a* will drive the material S in the principal path of movement X or toward the press, while actuation of the servo 203 and the ball screw 203*b* will drive the frame 205, and everything carried thereon, in the Y axis direction or, in other words, in a direction normal to the principal path of movement.

In this fashion, and assuming that the compensator 200 shifts in the Y axis simultaneously with the feeder 100, it is possible to compensate for any twisting tendency the stock between them might have and feed the stock cleanly into the press while still making it possible to shift normally of the principal feed path so as to fully utilize the entire width of the stock, notwithstanding the fact that the press itself contains only a limited amount of tooling.

In operation, it will be assumed that the coil 12 is mounted on the uncoiler 10 and is paid off that coil over the support roll 40, threaded through the compensator 200 by actuating the air cylinders 210,210 to lift the pressure roll 209*a* and then fed through the feeder 100 which is also accomplished by actuating the air cylinders 109*b*,109*b* to lift the pressure roll 111. The stock may then be fed to a position immediately adjacent the bed of the press. The pressure rolls 111 and 209*a* can then be lowered and the system is ready for operation.

At this time, starting a normal press cycle will involve opening and closing the press. According to a predetermined program, the need for stock will be relayed by suitable sensing means on the press to feeder 100 which will index a predetermined amount of stock into press 20 in the X direction. This will shorten the loop between feeder apparatus 100 and the compensator apparatus 200.

The sensor 60 will sense this and cause the compensator 200 to move the material forward in the X axis a predetermined distance. This shortens the loop between the compensator apparatus 200 and the uncoiler 10.

When sensor 50 senses this condition, it causes the uncoiler to index so that a predetermined amount of material is fed off the coil in the positive X direction.

Assuming the press to be cycling between open and closed positions, the press will then descend to the closed position and perform a forming operation on the portion of the stock S which is inserted into the press at that time. The press will then continue through its cycle and open, at which time, depending upon the amount of tooling and the requirements of the part, the stock S can either be indexed in the X axis again, or can be shifted laterally in the Y axis by shifting both the feeder apparatus 100 and the compensator apparatus 200 in that direction. This is all accomplished while the material is in the press and while the press is proceeding through its normal cycle of operation.

The press will then, of course, return to the closed position, at which time it will again perform the forming operation on the stock S.

It must be understood that the specific indexing pattern is not critical in that the stock could be indexed once in the X direction and then twice in the Y direction and then again in the X direction; could be indexed once in the X direction, once in the Y direction and then again in the X direction; could be indexed in both the X and Y directions simultaneously; or could be indexed in any number of variations, all of which would be dictated by a number of variables, such as the amount of tooling in the press, the size of the part being produced, the starting width of the stock, etc.

It is believed essential to understand that the key point in the invention is the capability of taking stock from a more or less endless coil, inserting it into a press and then shifting the stock in the press without having to remove it or without having to alter the normal cycle of operations of the press. The compensator apparatus 200 is important to this operation because it isolates any possible twisting of the stock in the area between it and the coil and insures that the stock is presented to the feeder and the press in the proper orientation.

While a full and complete description of the invention has been set forth in accordance with the dictates of the Patent Statutes, it should be understood that modifications can be resorted to without departing from the spirit hereof or the scope of the appended claims.

Thus, the invention is not intended to be limited to any particular press function and could be employed wherever coil stock is utilized.

Also, while specific drive means are disclosed, such as servos, suitable substitutions could be made without departing from the inventive concept disclosed herein.

What is claimed is:

1. A system for feeding a continuous length of stock from a coiled source of supply into a press along a principal feed path and shifting the stock transversely thereof, comprising:

(a) compensator means disposed in spaced relationship with respect to the source of supply along a principal feed path and selectively shiftable in a direction normal to the principal feed path;

(b) feeder means disposed between said compensator means and the press along the principal feed path and being selectively shiftable in a direction normal to the principal feed path; and (c) said compensator means and said feeder means being shiftable together in a direction normal to the principal feed path whereby the portion of the continuous length of stock within the press may be shifted in accordance with a preselected pattern.

2. The system of claim 1 wherein a first loop sensor is disposed between said feeder means and said compensator means and a second loop sensor is disposed between said compensator means and said source of supply.

3. The system of claim 1 wherein said compensator means includes a driven roll and a pressure roll for engagement with the stock.

4. The system of claim 3 wherein said driven roll and said pressure roll are shiftable in a direction normal to the principal feed path.

5. The system of claim 1 wherein said feeder means includes a driven roll and a pressure roll for engagement with the stock.

6. The system of claim 5 wherein said driven roll and said pressure roll are shiftable in a direction normal to the principal feed path.

7. A method of feeding a continuous length of coiled stock into a press along a principal feed path and shifting the stock transversely thereof, comprising the steps of:

(a) feeding stock from a coil through a compensator means in a principal feed path toward the press;

(b) feeding stock from the compensator to a feeder means in a principal path toward the press;

(c) feeding stock from the feeder means into the press along a principal path; and (d) selectively shifting the compensator and the feeder means simultaneously in a direction normal to the principal feed path while at least a portion of the continuous length of stock is within the press in accordance with a preselected pattern.

8. Apparatus for feeding a continuous length of stock from a coiled source of supply into a press along a principal feed path and shifting the stock transversely thereof, comprising:

(a) feeder means disposed adjacent the press and including (1) first drive means for advancing the stock toward the press; and (2) second drive means for selectively shifting said feeder means transversely with respect to the press; and (b) compensator means disposed between said feeder means and the source of supply and including (1) first drive means for advancing the stock toward the press; and (2) second drive means for selectively shifting said compensator means transversely with respect to the press simultaneously with the shifting of said feeder means while a portion of the continuous length of stock is within the press in accordance with a preselected pattern.

9. The apparatus of claim 8 wherein said feeder means includes a driven roll and a pressure roll for engagement with the stock; and said first drive means drives said driven roll.

10. The apparatus of claim 9 wherein said feeder means includes a mounting plate; said driven roll, said pressure roll and said first drive means are mounted on said mounting plate; and said second drive means drive said plate transversely of the press.

11. The apparatus of claim 10 wherein lift-off means are carried by said plate for moving said pressure roll toward and away from said driven roll.

12. The apparatus of claim 8 wherein said compensator means includes a driven roll and a pressure roll; and said first drive means drives said driven roll.

13. The apparatus of claim 12 wherein said compensator means includes a mounting plate; said driven roll, said pressure roll and said first drive means are carried by said plate; and said second drive means drive said plate transversely of the press.

14. The apparatus of claim 13 wherein lift-off means are carried by said plate for moving said pressure roll toward and away from said driven roll.

* * * * *